United States Patent [19]

Christel, Jr.

[11] Patent Number: 4,496,940

[45] Date of Patent: Jan. 29, 1985

[54] SENSING AND INDICATOR SYSTEM FOR DETECTING HEATING ELEMENT FAILURES

[75] Inventor: Conrad Christel, Jr., Dryden, N.Y.

[73] Assignee: Pall Corporation, Glen Cove, N.Y.

[21] Appl. No.: 339,686

[22] Filed: Jan. 15, 1982

[51] Int. Cl.[3] ..... G08B 21/00

[52] U.S. Cl. ..... 340/640; 55/33; 55/274; 55/DIG. 34; 219/506; 340/642; 340/652; 340/655

[58] Field of Search ..... 340/640, 650, 651, 652, 340/655, 641, 642; 55/33, 208, 274, 275, DIG. 34; 219/506; 361/42, 47, 48, 76, 77, 92

[56] References Cited

U.S. PATENT DOCUMENTS

| | | | |
|---|---|---|---|
| 2,759,177 | 8/1956 | Hightower | 340/651 X |
| 3,513,631 | 5/1970 | Seibert et al. | 55/33 |
| 3,716,718 | 2/1973 | Nowell | 307/13 |
| 4,053,876 | 10/1977 | Taylor | 340/529 |
| 4,198,628 | 4/1980 | Laber | 340/650 |
| 4,322,223 | 3/1982 | Christel | 55/33 X |
| 4,364,007 | 12/1982 | Cutler et al. | 340/651 X |
| 4,421,976 | 12/1983 | Jurek | 219/506 |

FOREIGN PATENT DOCUMENTS 1578081 10/1980 United Kingdom .

*Primary Examiner*—James L. Rowland
*Assistant Examiner*—Daniel Myer
*Attorney, Agent, or Firm*—Leydig, Voit, Osann Mayer and Holt, Ltd.

[57] ABSTRACT

A sensing and indicator system for monitoring multiple electric heating elements connected in three-phase balanced Y circuits in heat reactivatable adsorbent gas fractionators. The system senses a failure induced imbalance, pinpoints the location of the group with the failure and causes a failure indicating alarm to function. The system operates by a sensing circuit including a discharge bulb sensing the failure induced imbalance and causing a conduction of current through the system resulting in the activation of an alarm and the illumination of the gas discharge bulb indicating which of multiple sets of heating elements has failed.

9 Claims, 2 Drawing Figures

SENSING AND INDICATOR SYSTEM FOR DETECTING HEATING ELEMENT FAILURES

TECHNICAL FIELD

The present invention relates generally to sensing systems for detecting the failure of heating elements or other resistive loads. More specifically, it relates to sensing and indicator systems for monitoring multiple electric heating elements in heat reactivatable adsorbent gas fractionators, in which a desiccant is employed to absorb moisture from air and in which heat is employed to regenerate the spent desiccant at the conclusion of the drying cycle.

BACKGROUND ART

Desiccant dryers have been marketed for many years and are in wide use throughout the world. The usual type is made up of two desiccant beds, one of which is on the drying cycle while the other is being regenerated. The gas to be dried is passed through the desiccant bed in one direction during the drying cycle and then, when the desiccant has adsorbed moisture to the point that there is no assurance that the moisture level of the effluent gas will meet the requirements of the system, the gas to be dried is switched to the other bed and the spent bed is regenerated by passing purge effluent gas in a counterflow therethrough.

The purge gas may be heated before entering the bed but in many systems the bed itself is provided with heaters and the desiccant, in effect, baked out to remove the adsorbed moisture. One such system is disclosed in Seibert et al., U.S. Pat. No. 3,513,631. In the dryer of Seibert et al. there are disposed in each desiccant bed, heating elements. There is no provision, however, for detecting the failure of any heating element in either bed.

There are available a variety of sensing devices to determine when the flow of air should be switched from one desiccant bed to the other. One such device detects the moisture content in the desiccant bed and causes the drying cycle time to be modified according to the moisture load. A method of measuring the moisture load is disclosed in Seibert et al., U.S. Pat. No. 3,448,561. With moisture sensing regenerating systems of this type, the sensing probe is usually in a fixed location within the desiccant bed. If one or more of the heating elements in the desiccant bed should fail, the result of such failure will vary, depending on the location of the heating element, vis-a-vis the probe. If they are in close proximity, the probe will detect moist air and will signal that regeneration is necessary prematurely, resulting in a shorter than desired drying cycle, thus wasting energy and resulting in a shorter life for the desiccant. If the probe and heating element are not close, the probe will be unaware of the moist, undesiccated air in the area of the failed heater. Therefore, the drying will proceed as if there were no failure, resulting in moisture-laden air contaminating the effluent.

Another means for controlling the drying and regenerating cycle times is by use of a timer. Such a system is described in Christel, U.S. Pat. No. 4,322,223. A series of switches and valves are controlled by the timer to switch the heaters on and off and the gas stream from one bed to another. The time of the required cycle is determined experimentally based upon load, temperature of gas, temperature generated in the desiccant bed, effluent requirements and any other applicable factors.

If the heating element should fail, the temperature reached in the desiccant bed would not be as high as expected. This could result in moisture-laden air in the effluent due to a lack of proper desiccant bed regeneration.

It is, therefore, of utmost importance to know of heating element failures in time to take the necessary steps to prevent moisture-laden air from contaminating the effluent.

DISCLOSURE OF INVENTION

Accordingly, it is the primary aim of this invention to provide a system for sensing the failure induced imbalance in one of a plurality of normally balanced circuits of resistance loads.

Another object of the invention is to provide a means of indicating in such a system which of the circuits is imbalanced.

A further object is to warn of the existence of such as imbalance in a timely manner.

It is a more specific object of this invention to provide a system for detecting failure induced imbalance in one of a plurality of normally balanced circuits of heating elements distributed throughout the structure of a dryer or like heating apparatus.

Still a further object is to provide in such a system a means for indicating which group of the heating elements has a failed element.

Another object is to provide in such a system an alarm to warn the user of a heating element failure in a timely manner.

A further object is to provide means for indicating the physical location of a failed heating element group in a desiccant dryer having a large multiplicity of elements.

Another object of the invention is to provide a system which detects the failure of one of multiple heating elements arranged in three-phase balanced Y circuits and is capable of detecting the failure of one of the heating elements of a heating apparatus having a multiplicity of heating elements with a simple detection system comprised of only a few circuit components.

BRIEF DESCRIPTION OF DRAWINGS

Other objects and advantages of the invention will become apparent upon reading the following detailed description and upon reference to the drawings, in which.

BEST MODE FOR CARRYING OUT THE INVENTION

Figure 1:
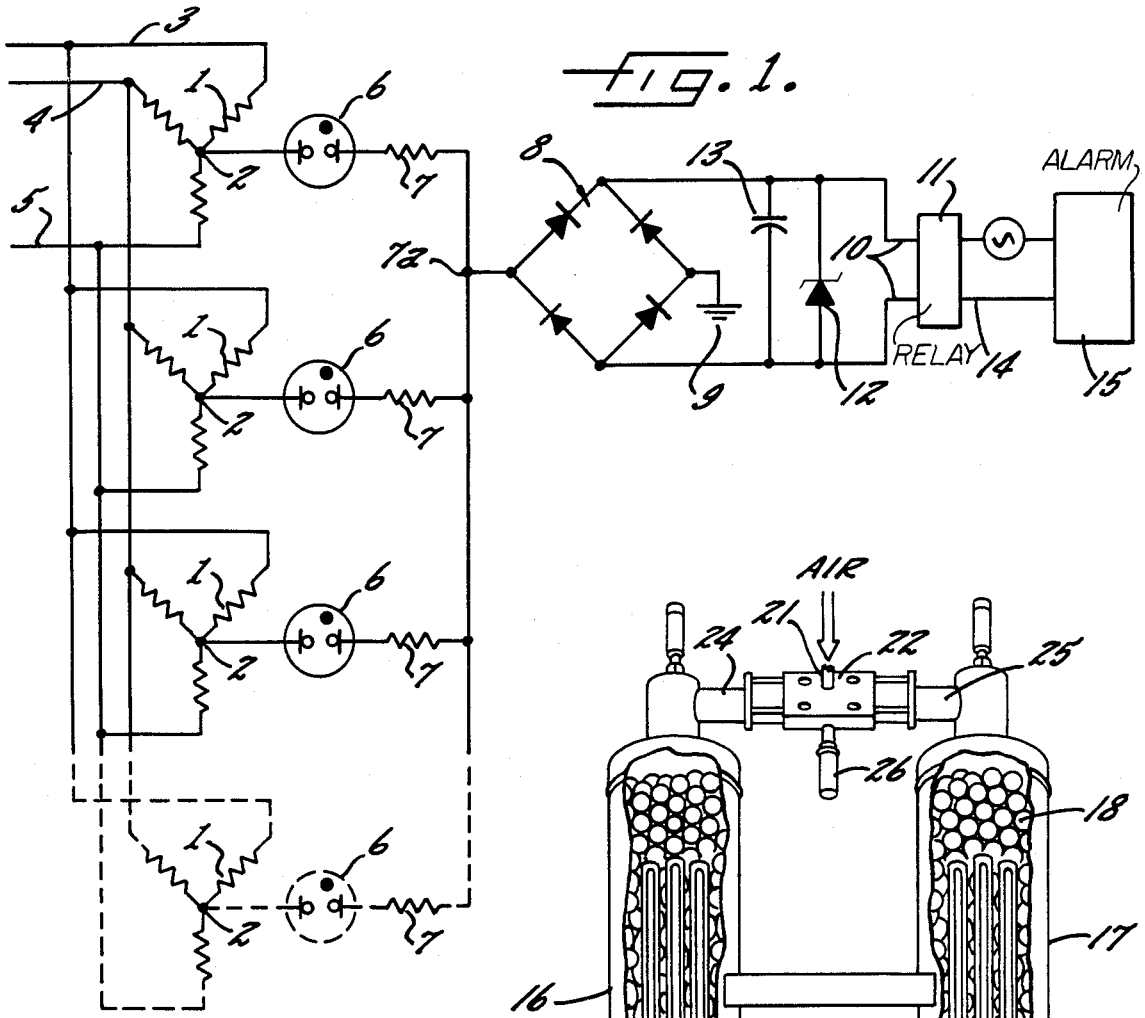
FIG. 1 is a schematic illustration of groups of Y wired load resistance elements and a sensing system constructed according to the invention for detecting failure induced imbalance in said groups of elements.

Turning now to the drawings, a sensing system is provided for detection of heater element failures where the heating elements 1 are connected in groups of three in a balanced Y circuit with a center node 2 across three phase lines 3, 4, 5 as shown in FIG. 1. According to the invention, the failure sensing system includes a circuit connected to each of the center nodes 2 of the groups of heating elements 1 (four sets are shown, there can be more or less) and having circuit means for sensing the rise in voltage of a center node 2 resulting when a heating element 1 fails, creating an imbalance in the previously balanced three phase circuit because the two remaining heating elements will, in effect, be series connected across two phase lines and subjected to a total voltage differential of 460 volts in the standard 460 volt three phase system. Thus, the voltage at the center node will rise to 133 volts $$\left(\frac{460}{2\sqrt{3}}\right)$$

with respect to neutral or ground.

The voltage generated by this imbalance sends a current through a gas discharge lamp 6 and current limiting resistor 7 connecting the imbalanced node to a bridge rectifier 8. The rectifier 8 provides D.C. signal to drive the input of a solid state relay 11. The output from this relay can then be used to control a signalling device or alarm 15, such as a bell, siren, buzzer or whistle.

The reasons for using gas discharge tubes are threefold. Without these lamps, the current limiting resistors going to the various Y group center nodes would provide an averaging effect because they have a common connection to node *7a* at the input to the bridge rectifier 8. For example, in a desiccant bed having 45 heating elements (15 Y groups), the failure of one element would result in an imbalance voltage of only 8.85 VAC at the input to the bridge rectifier in a 460 VAC system. This small voltage could be exceeded by normal tolerance of incoming line imbalance and heater resistance variance, thereby creating an indication of heater failure, even if all heaters are operating properly.

A gas discharge lamp conducts no current at all until its breakdown voltage is reached. It thus serves as a means for allowing current flow only when a breakdown voltage is reached. It then reverts to a lower maintaining voltage. A neon lamp, such as the NE83 selected for this circuit, has a breakdown voltage of 65 volts and a maintenance voltage of 61 volts. When a heater failure occurs, it causes one lamp to conduct. However, a combination of bridge diodes and a zener diode provides voltage limiting means for limiting the voltage at the common connection and node *7a* input to the bridge rectifier to 5.5 volts. This low voltage will not cause conduction through any of the remaining lamps to center nodes that are still in balance. Therefore, there is no averaging effect between balanced and unbalanced center nodes.

Thus, the three functions of the lamps are to establish a minimum threshold voltage for triggering an alarm so that normal line imbalances and heater resistance variations will not cause a false alarm. They also isolate each center node, allowing the system to operate with an unlimited number of heaters. As indicator lamps, they can give a quick visual indication of which group of three heating elements has the failed element.

The gas discharge lamps may be replaced by pairs of zener diodes back-to-back in series. This would perform the first two functions and allow for a warning system. However, it would not provide the visual indicator to narrow the location of the failed element.

Turning to FIG. 1, the heating element groups shown are composed of three resistive heating elements 1 connected in a Y configuration, creating a center node 2 which is at zero voltage. Each of the heating elements is connected to a phase of an incoming three phase power line 3, 4, 5.

The failure sensing circuit is composed of a series of gas discharge bulbs 6, such as NE83, each of which receives the voltage from the center node 2 of the respective group of heater elements. The number of gas discharge tubes will be equal to the number of Y groups of heating elements. This gas discharge tube 6 provides a connection through a current limiting resistor 7 between the imbalanced node and a bridge rectifier 8 composed of IN4001 rectifiers. The rectifier 8 is connected to a ground 9 and supplies a D.C. signal supply to the input 10 of a solid state relay 11, such as a Hamlin type 7564. A zener diode 12 is connected across the input 10 of the solid state relay. Such diode 12 may be of a type 1N4731. A filter capacitor 13 is installed across the output of rectifier 8 to assure a steady current supply to the solid state relay 11. The output 14 of the solid state relay 11 may be used to control any signalling device or alarm 15, such as a bell, buzzer, siren, etc., with which it is compatible.

Figure 2:
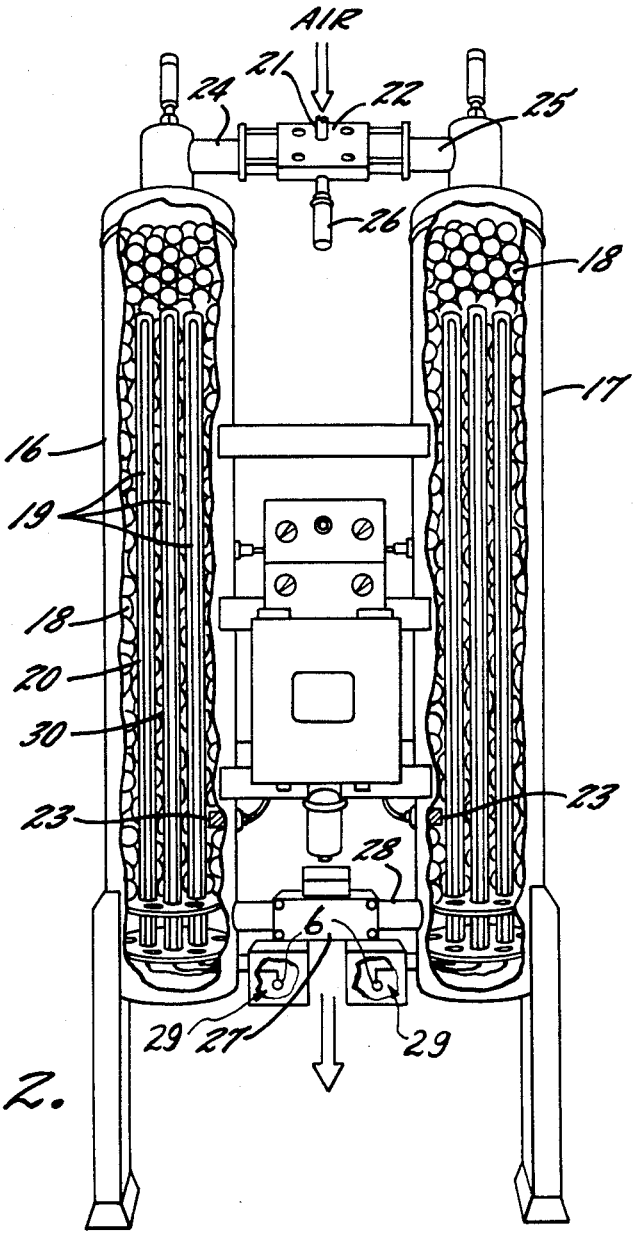
FIG. 2 is a schematic diagram of a heat-reactivatable adsorbent gas fractionator with Y wired heating elements and a sensing system as illustrated in FIG. 1.

In the particular device illustrated in FIG. 2 the adsorbent gas fractionator, in accordance with this invention, is composed of a pair of sorbent vessels 16, 17 which are disposed vertically. Each vessel contains a bed of sorbent 18, such as alumina or silica gel, or a combination of sorbents. Three heater tubes 30 are provided through which heating elements 20 are disposed.

The system includes an inlet 21 to a switching valve assembly 22 which may be activated by a timer or other means, such as a probe 23 for example, such as that described in Seibert et al., U.S. Pat. No. 3,448,561. This valve 22 directs the flow of influent gas to one of the two inlet lines 24, 25 leading the influent gas to the respective vessel 16, 17. The valve 22 also directs purge flow from the off-stream vessel being regenerated to the purge exhause 26.

As wet air enters through switching valve 22, it is directed through the inlet line 24 into tank 16 where it is directed downward through the sorbent bed 18. As the air passes through chamber 16, moisture is adsorbed by sorbent and dry air exits through check valve 27. During the passage of air through chamber 16, the probe 23 is monitoring the moisture content of the air in chamber 16 at the probe. The other chamber 17, which was wetted in a previous cycle, is being regenerated. Regeneration takes place by chamber 17 being depressurized to atmospheric pressure in an upward flow direction through valve 22, with the gas exiting through the purge exhaust 26.

A portion of the dry air exiting chamber 16 through check valve 27 is directed through line 28 into chamber 17 and using heat generated by heaters 20, removes the moisture from the sorbent 18. This moisture is carried by the purge air out of the chamber through valve 22 and out the purge exhaust 26. When the regenerating chamber 17 is regenerated, the purge exhaust valve 22 is closed while purge gas continues to enter chamber 17 through line 28 until full line pressure is reached.

When the probe 23 in chamber 16 senses that the drying capacity has been depleted, the switching valve 22 switches to allow wet air to flow into the second chamber 17 through line 25, at which time the process described repeats itself for the other chamber.

Connected to each set of three electric heaters 20 is one terminal of heater burnout indicator 29 whose circuitry is shown in detail in FIG. 1. Each gas discharge tube 6 of the burnout indicator, mounted on a panel on the front of the dryer, is connected to a center node 2 of Y wired heaters 1, as shown in FIG. 1.

Thus it is apparent that there has been provided, in accordance with the invention, a heating element failure indicating system that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A sensing device for detecting failure induced imbalance in one of a plurality of normally balanced circuits of load resistance elements connected to center nodes in three phase balanced Y circuits comprising, in combination:

a plurality of sensing circuits connected to a common node;

each sensing circuit being connected to the corresponding center node of one of said balanced Y circuits for sensing the voltage rise at said corresponding center node due to failure induced imbalance, each sensing circuit including a device for allowing a current flow through the sensing circuit responsive to a voltage rise at the corresponding center node only when a predetermined breakdown voltage is reached, each said device further serving as a means for isolating the corresponding center node from the center nodes of the other of said plurality of balanced Y circuits and preventing averaging of the voltage rise when an imbalance occurs at a center node, each said sensing circuit also including current limiting means; and voltage limiting means including a circuit connected to said common node for limiting the voltage at said common node to below said predetermined breakdown voltage upon a failure induced imbalance and current flow through one of said sensing circuits.

2. A sensing system according to claim 1 wherein each said device further serves for indicating a current flow when said predetermined breakdown voltage is reached.

3. A sensing system according to claim 2 wherein each said device comprises a gas discharge bulb serving as said means for allowing a current flow only when a predetermined breakdown voltage is reached.

4. A sensing system according to claim 1 wherein said device in each said sensing circuit is an indicating device.

5. A sensing system according to claim 1 having detecting means connected to said voltage limiting means for detecting a current flow through any of said sensing circuits.

6. A sensing system according to claim 5 wherein said voltage limiting means includes a rectifier circuit and a zener diode for limiting the voltage at said common node to below said predetermined breakdown voltage so that the voltage at said common node does not rise sufficiently to cause current flow through other of said sensing circuits connected to said common node.

7. A sensing system according to claim 5 wherein said detecting means includes a signaling device.

8. A sensing system according to claim 1 wherein said voltage limiting means includes a zener diode.

9. A sensing system according to claim 1 wherein said load resistance elements are electric heating elements.

* * * * *